US005169515A

United States Patent [19]

Ngan et al.

[11] Patent Number: 5,169,515

[45] Date of Patent: Dec. 8, 1992

[54] PROCESS AND ARTICLE

[75] Inventors: Danny Y. Ngan; Randy C. John, both of Houston, Tex.

[73] Assignee: Shell Oil Company, Houston, Tex.

[21] Appl. No.: 803,697

[22] Filed: Dec. 4, 1991

Related U.S. Application Data

[63] Continuation of Ser. No. 374,337, Jun. 30, 1989, abandoned.

[51] Int. Cl.[5] ..... C11G 9/12

[52] U.S. Cl. ..... 208/48 R; 148/286; 148/280

[58] Field of Search ..... 208/48 R; 148/280, 283, 148/286

[56] References Cited

U.S. PATENT DOCUMENTS

| | | | |
|---|---|---|---|
| 2,269,601 | 1/1942 | Perrin | 148/286 |
| 2,442,223 | 5/1948 | Uhlig | 148/286 |
| 2,502,855 | 4/1950 | Kingston | 148/286 |
| 3,164,493 | 1/1965 | Lindberg | 148/286 |
| 3,377,213 | 4/1968 | Hiller | 148/286 |
| 3,519,496 | 7/1970 | Finn | 148/286 |
| 3,865,634 | 2/1975 | Bagnoli | 148/286 |
| 4,017,336 | 4/1977 | Foroulis | 148/286 |
| 4,086,107 | 4/1978 | Tanino et al. | 148/136 |
| 4,168,993 | 9/1979 | Wilson et al. | 148/12 B |
| 4,559,090 | 12/1985 | Grutzner | 148/12 E |
| 4,650,700 | 3/1987 | Kitamura et al. | 427/255.6 |
| 4,661,171 | 4/1987 | Takashi et al. | 148/247 |
| 4,678,717 | 7/1987 | Nickola et al. | 428/553 |
| 4,701,354 | 10/1987 | Kitamura et al. | 427/255.6 |
| 4,737,204 | 4/1988 | Anton et al. | 148/325 |
| 4,776,897 | 11/1988 | Takashi et al. | 148/242 |

FOREIGN PATENT DOCUMENTS 656910 1/1948 United Kingdom .

OTHER PUBLICATIONS

Albright et al, "Pretreatment of High-Alloy Steels to Minimize Coking in Ethylene Furnaces," *Novel Production Methods for Ethylene, Light Hydrocarbons and Aromatics*, Marcel Dekker, Inc., N.Y. (1992).

Albright, L. F., "Metal Diffusion from Furnace Tubes Depends on Location," *Oil and Gas Journal*, Aug 15, 1988.

Letter for L. F. Albright dated Jan. 8, 1992.

*Primary Examiner*—Sam Silverberg

[57] ABSTRACT

A process for heat treatment of high temperature steels in which the steels are heated to temperatures of at least 1800° F. in the presence of hydrogen gas, methane, hydrogen sulfide, and steam. Articles made by the process have a unique layer enriched in chromium oxide, and reactor components made from the treated steel may be used in a process for the pyrolysis of liquid and gaseous hydrocarbons to inhibit coking.

6 Claims, No Drawings

PROCESS AND ARTICLE

This is a continuation of application Ser. No. 374,337, filed Jun. 30, 1989 now abandoned.

FIELD OF THE INVENTION

The invention relates to the heat treatment of high temperature steels, and is particularly relevant to the heat treatment of stainless steels used in pyrolysis units and other high temperature reactors. The invention also relates to the pyrolysis of liquid and gaseous hydrocarbons, particularly to the pyrolysis of such materials to form olefins.

BACKGROUND OF THE INVENTION

Steels capable of withstanding the high temperatures commonly utilized in various industrial processes, such as the pyrolysis of various hydrocarbon materials, are well known. A problem common to a number of such processes is that of the formation of "coke", a carbon-rich material which forms deposits on the surfaces defining the reaction zone and in downstream quench equipment. Coke represents a substantial deficit in operations, since it restricts flow and is a thermal insulator. Thus, as coke deposits on the reactor surfaces, higher and higher tube wall temperatures are required to sustain the reaction or process in operation.

A common practice conducted in such operations is known as "de-coking". To carry out de-coking, process operations are periodically discontinued and the deposits are removed by various techniques, e.g., by oxidation with a steam/air mixture. The required downtime results in substantial loss of operation or production, and much effort has been expended in attempts to extend the time between de-coking.

Evidence exists that nickel and iron in the steels used for reactors promote coking in certain temperature ranges. A variety of techniques have been employed to overcome the presence of the nickel and iron, with varying results. Accordingly, a technique or equipment which might extend the time before de-coking is required and/or inhibit coking so that the process operations might be carried out at greater severities would have great economic value. Also, a pyrolysis process having these characteristics would be of great importance. The invention is directed to such.

SUMMARY OF THE INVENTION

Accordingly, in one embodiment, the invention relates to a process for heat treatment of an article of high temperature steel comprising heating the article to a temperature of at least 1800° F. in the presence of hydrogen, methane, or methane forming hydrocarbons, an effective amount of hydrogen sulfide, and steam, for a time sufficient to produce a surface layer having a concentration of chromium greater than that of the interior of the article, the concentration of nickel of the outermost portion of said surface layer being less than three percent by weight, based on the weight of the layer, the molar ratio of hydrogen to steam being from about 0.05 to about 5. Unless stated otherwise, all ratios given herein are molar ratios.

In another embodiment, the invention is directed to an article of manufacture comprising an article or blank of high temperature steel, at least a portion of the article or blank comprising a surface layer having a concentration of chromium greater than the interior of the article, the concentration of nickel of the outermost portion of said surface layer being less than about three percent by weight, based on the weight of the layer, the layer being formed by heating at least a portion of the blank to a temperature of at least 1800° F. in the presence of hydrogen, methane, or methane forming hydrocarbons, an effective amount of hydrogen sulfide, and steam, for a time sufficient to reduce the concentration of nickel of a surface layer of said article to less than three percent by weight, based on the weight of the layer, the ratio of hydrogen to steam being from about 0.05 to about 5. Alternately, the article may comprise a tube of high temperature steel, at least a portion of either the inner or outer side of the tube comprising a surface layer having a concentration of chromium greater than that of the interior of the tube, the concentration of nickel of the outermost portion of said layer being less than three percent by weight, and being formed by heating at least a portion of the inner or outer surface of the tube to a temperature of at least 1800° F. in the presence of hydrogen, methane, or methane forming hydrocarbons, an effective amount of hydrogen sulfide, and steam for a time sufficient to reduce the concentration of nickel of at least a portion of said surface layer to less than three percent by weight, based on the weight of the layer, the ratio of hydrogen to steam being from 0.05 to 5.

In another embodiment, the invention is directed to a process comprising a) pyrolyzing a liquid or gaseous hydrocarbon material in a high temperature steel pyrolysis reactor;

b) discontinuing pyrolyzing said material, and de-coking the surface or surfaces which define the reaction zone of said reactor;

c) discontinuing the de-coking of said surface or surfaces; and d) heating at least a portion of the surface of the wall or walls of high temperature steel which defines the reaction zone of said reactor to a temperature of at least 1800° F. in the presence of hydrogen, steam, methane or methane forming hydrocarbons, and an effective amount of hydrogen sulfide, for a time sufficient to produce or provide a surface layer on said steel having a chromium concentration greater than that of the interior of the steel and a concentration of nickel in at least the outermost portion of said surface layer of less than three percent by weight, based on the weight of the layer, the ratio of hydrogen to steam being from 0.05 to 5.0.

The term "hydrogen", as used herein, includes the use of pure hydrogen as well as streams containing large amounts of other gaseous materials, provided that they do not interfere substantially with the nickel concentration reduction phenomena described herein or their interfering effect can be minimized. For example, the hydrogen may be supplied from streams commonly found in chemical operations or in refineries. The hydrogen (and steam) will be supplied in an amount sufficient to reduce the concentration of nickel to the level mentioned. However, significant amounts of components that inhibit or prevent the reduction of nickel concentration must be avoided, except as described more fully hereinafter. While applicants have no desire to be bound by any theory of invention, it is believed that the hydrogen and steam selectively oxidize the surface of the steel to provide a build up of chromium oxide, and there is also support for the migration of nickel and iron to the interior of the steel structure.

Accordingly, the heat treatment is carried out in the substantial absence of materials which might maintain the presence of nickel in undesired concentrations at the surface in contact with reaction gases. In this regard, the presence of methane as a component of various streams has been found to maintain the nickel concentration, and is deleterious to the treatment process of the invention. Thus, if significant quantities, that is, amounts of methane, or hydrocarbons which form methane under the conditions of the heat treatment described herein (methane forming hydrocarbons), are present which inhibit or interfere with the nickel concentration reduction phenomena described herein, it has been discovered that the presence or addition of an effective amount of hydrogen sulfide overcomes or minimizes the effect of the methane, and provides the beneficial effects of the invention. As used herein, the term "effective amount", with respect to the amount of hydrogen sulfide utilized, is that amount which will counteract the effect of the methane to the extent desired. Preferably, the amount of hydrogen sulfide will range from about 100 ppm to about 500 ppm, based on the total volume of gas, assuming a methane content of 0.01 to 10 percent, based on the total volume of gas.

In a similar manner, the steam and hydrogen sulfide need not be pure, provided that compositions that prevent the increase of chromium concentration or the reduction of nickel concentration are avoided. Those skilled in the art may readily determine the suitability of a given stream for the process of the invention simply by testing it at appropriate temperatures.

The heat treatment is carried out, as indicated, at a temperature of at least 1800° F., preferably 1900° F. or 1925° F. to about 2200° F. Pressures are not critical, ranging from one atmosphere to one hundred atmospheres. Similarly, volumes and velocities of the gases employed are not critical, as will be understood by those skilled in the art, and will be adjusted depending on the need to maintain the appropriate temperature and gas composition. As indicated, the hydrogen to steam ratio will be maintained from 0.05 to 5, preferably 0.05 to 2.

The heat treatment is carried out for a time sufficient to achieve the desired reduction of nickel concentration. This may be determined by experimentation, i.e., by treatment of the surface for a time and then analysis of the surface. In general, the treatment will be carried out for a period of from 2 hours to 24 hours, preferably from 4 hours to 6 hours.

The types of steels employed are those commonly used for high temperature purposes, i.e., 1500° F. to 2200° F. Preferred steels are those commonly described as austenitic, but other steels may be employed. Suitable steels include cast or wrought heat resistant stainless steels such as HK-40 and Incoloy 800, and will generally include those steels having minimum nickel concentrations of about 8 percent and chromium concentrations of at least 15 percent, all percentages based on the total weight of the steel. It has been determined that the heat treatment of the invention produces a layer strongly depleted in nickel and iron, relative to their content in the steel, i.e., enriched in chromium, on the surface of the steel, the enriched layer being from about 1 to 5 microns or so in thickness. This effect occurs whether or not the steel is virgin metal or carburized metal. The layer will comprise an outer portion or "sub-layer" which is highly enriched in chromium, the chromium present substantially or substantially as chromium oxide ($Cr_2O_3$), and the chromium concentration decreasing in a gradient toward the interior of the steel, the sub-layer, which will be of at least 0.1 to 0.2 microns in thickness, having a nickel concentration of less than three percent by weight, as noted. Articles produced according to the invention have been determined to maintain low nickel concentrations on subsequent exposure to various atmospheres including steam/hydrogen sulfide/methane. However, articles made according to the invention and subsequently heat treated at lower temperatures with hydrogen and steam increase nickel and iron concentrations near their surfaces.

The particular manner of pyrolysis and the method of de-coking form no part of the invention, and may suitably be carried out by those skilled in the art. For example, those procedures, materials, and conditions described in U.S. Pat. No. 3,433,731 (Oliver) and U.S. Pat. No. 4,279,734 (Gwyn), incorporated herein by reference, may be used.

ILLUSTRATIVE EMBODIMENTS

The following experiments were performed.

I

A coupon of HK-40, a high temperature stainless steel, was heated at about 1950° F. in the presence of hydrogen, about 7 percent by volume methane, and steam for a period of about four hours, the ratio of hydrogen to steam being about 50 to 1. The coupon was then maintained at 1950° F. for about 16 hours, the ratio of hydrogen to steam being changed to about 0.67 during this time. A surface layer somewhat enriched in chromium oxide, but having only a slightly reduced content of nickel and iron, was produced.

II

A coupon of HK-40 was heated for 24 hours at about 1950° F. in the presence of a gas comprising steam and argon. The heat treatment was then maintained for another 24 hours, but the treating gas was changed to a mixture of a first gas comprising 56 percent hydrogen, about 4 percent methane, about 200 ppm hydrogen sulfide, and about 39 to 40 percent argon, with a second gas comprising steam, the ratio of the first gas to steam being about 0.67. A surface layer, enriched in chromium oxide, of about 1 to 2 microns was produced, the layer being substantially depleted in nickel and iron (less than three percent by weight nickel in the upper 0.1 to 0.2 microns of the layer, based on the weight of the layer).

In order to illustrate the pyrolysis aspect of the invention, the following illustrative embodiment is given. All values are exemplary or illustrative.

Accordingly, naphtha is pyrolyzed under suitable conditions until it is determined by measurement of pressure drop or outer tube wall temperature that excess coke is present on the tube surfaces of a conventional pyrolysis reactor. Alternatively, de-coking may be carried out as a regularly scheduled procedure in plant operation. Whatever the case, the reaction is discontinued, and the reactor is then de-coked according to standard procedure, e.g., utilization of mixtures of steam and air to burn the coke off. De-coking is then stopped, and the heat treatment of the invention is begun.

Preferably, the pyrolysis reactor is swept with a diluent gas, such as nitrogen or steam, and hydrogen is introduced. In the normal plant situation, a plant hydrogen stream containing 93 molar percent hydrogen, and 7 percent methane is provided. Steam is mixed with the hydrogen so that the inner surfaces of the tubes of the reactor are treated with a mixture of steam and hydrogen having a ratio of 1.7 parts steam to 1 part hydrogen (molar basis). About 200 ppm of hydrogen sulfide is added to the mixture. By way of illustration, assuming a steam flow of 10,000 pounds per hour, about 1000 pounds per hour of plant hydrogen will be used. The temperature is maintained at about 1950° F., and the treatment is carried out for about 4 hours. At this point the flow of the steam-hydrogen mixture is stopped, and the pyrolysis reaction is resumed.

Various changes and modifications may be made without departing from the spirit and scope of the invention, as will be apparent to those skilled in the art.

What is claimed is:

1. A process for heat treatment of an article of high temperature steel comprising heating said article to a temperature of at least 1800° F. in the presence of hydrogen, methane, an effective amount of hydrogen sulfide, and steam, for a time sufficient to produce a surface layer having a concentration of chromium, substantially in the form of chromium oxide greater than the interior of the article, the concentration of nickel of the outermost portion of said surface layer being less than three percent by weight, based on the weight of the layer, the ratio of hydrogen to steam being from 0.05 to 5.0.

2. A process comprising a) pyrolyzing a liquid or gaseous hydrocarbon material in a high temperature steel pyrolysis reactor;

b) discontinuing pyrolyzing said material, and de-coking a surface or surfaces which define the reaction zone of said reactor;

c) discontinuing the de-coking of said surface or surfaces;

d) heating at least a portion of the surface of the wall or walls of high temperature steel which define the reaction zone of said reactor to a temperature of at least 1800° F. in the presence of hydrogen, steam, methane or a methane forming hydrocarbon, and an effective amount of hydrogen sulfide, for a time sufficient to produce a surface layer on said wall or walls having a chromium concentration, substantially in the form of chromium oxide greater than that of the interior of said wall or walls and a concentration of nickel of at least the outermost portion of said surface layer of less than three percent by weight, based on the weight of the layer, the ratio of hydrogen to steam being from 0.5 to 5.0.

3. The process of claim 2 wherein pyrolysis of the liquid or gaseous hydrocarbon is resumed after the heating of step d).

4. The process of claim 1 wherein the article is heated to a temperature of at least 1925° F.

5. The process of claim 2 wherein the high temperature steel is an austenitic steel and the temperature to which at least a portion of the surface of the wall or walls of the steel is heated is at least 1925° F.

6. The process of claim 3 wherein the high temperature steel is an austenitic steel and the temperature to which at least a portion of the surface of the wall or walls of the steel is heated is at least 1925° F.

* * * * *